US006170819B1

(12) United States Patent
Crosby et al.

(10) Patent No.: US 6,170,819 B1
(45) Date of Patent: Jan. 9, 2001

(54) NON-CONTACT SHEET HANDLING SYSTEM AND METHOD OF USING SAME

(75) Inventors: John D. Crosby, Stamford, CT (US); Tomas Garlin, Tranás (SE); C. Robert Gasparrini, Rye, NY (US)

(73) Assignee: Baldwin Graphic Systems, Inc., Shelton, CT (US)

( * ) Notice: Under 35 U.S.C. 154(b), the term of this patent shall be extended for 0 days.

(21) Appl. No.: 09/129,557

(22) Filed: Aug. 5, 1998

(51) Int. Cl.[7] ..... B65H 29/24

(52) U.S. Cl. ..... 271/196; 271/195; 406/88; 406/94; 406/95

(58) Field of Search ..... 271/194, 195; 406/88, 94, 95, 104, 89, 90

(56) References Cited

U.S. PATENT DOCUMENTS

| | | | |
|---|---|---|---|
| 4,572,071 | | 2/1986 | Cappel et al. . |
| 4,630,975 | | 12/1986 | Becker . |
| 4,702,664 | | 10/1987 | Lukens, Jr. . |
| 4,811,493 | * | 3/1989 | Burgio, Jr. ..... 34/4 |
| 5,411,251 | * | 5/1995 | Schmid et al. ..... 271/195 |
| 5,634,636 | | 6/1997 | Jackson et al. . |
| 5,797,327 | * | 8/1998 | Gieser et al. ..... 271/195 |

FOREIGN PATENT DOCUMENTS

| | | | |
|---|---|---|---|
| 5-124746 | * | 5/1993 | (JP) . |
| 6-80270 | | 3/1994 | (JP) . |

* cited by examiner

*Primary Examiner*—Donald P. Walsh
*Assistant Examiner*—Jonathan R. Miller
(74) *Attorney, Agent, or Firm*—Morgan & Finnegan, LLP

(57) ABSTRACT

A non-contact sheet handling system includes a first valve controlling air flow to a manifold and a second valve controlling air flow from the manifold to an air pan. A non-contact plate having venturis covers the air pan. In an alternate embodiment, the system includes a diffuser that diffuses air flow in the air pan. A method of using a non contact sheet handling system includes adjusting a first and second valve to set air flow to a first and second area, respectively, of the system and adjusting a third valve to set air flow to the first and second valves.

26 Claims, 6 Drawing Sheets

NON-CONTACT SHEET HANDLING SYSTEM AND METHOD OF USING SAME

BACKGROUND OF THE INVENTION

1. The Field of the Invention

The present invention relates generally to sheet handling systems of sheet fed presses, and, more particularly, to a non-contact sheet handling system for use at the delivery of a sheet fed press.

2. Description of Related Art

In sheet fed presses, after each sheet passes through the last printing unit of the press, the sheet enters an area of the press known as "the press delivery". The press delivery includes, among other thing, devices for drying or setting the ink on the printed sheets. Such devices include, for example, air showers and infra red (IR) drying heads, or ultra violet (UV) drying heads.

Printed sheets move through typical sheet fed press deliveries by sliding across a series of parallel rods. The sheets are carried across the top of a plurality of rods (typically five), which run parallel to the direction of sheet movement. A series of gripper bars, which move along a track, carry the sheets through the delivery. Specifically, each gripper bar is propelled along a motorized track that also runs parallel to the movement of the sheet through the delivery. Each gripper bar has a series of metal fingers that grasp the leading edge of a printed sheet allowing it to drag the sheet over the rods, through the delivery. Because the printed sheets slide across and are in physical contact with the rods, such systems are referred to as "contact" sheet handling systems.

Contact sheet handling systems place limitations on the usable area of each sheet. Specifically, the sheets cannot have printed material in the areas where the sheet contacts any of the rods. If a printed area of a sheet were to contact the rods, the ink would smear. Accordingly, the printable area of the sheet is limited by the contact sheet handling systems. Therefore, a need exists for an improved sheet handling system, particularly one that provides a greater usable area per sheet.

3. Summary of the Invention

The present invention satisfies such a need. A non- contact sheet handling system according to one embodiment of the present invention includes a manifold and an air pan. The system also includes a first valve controlling air flow to the manifold and a second valve for controlling air flow from the manifold to the air pan. A non-contact plate having openings covers the air pan. In various alternate embodiments, the system further includes a diffuser that diffuses air flow through the interior of the air pan.

Similarly, a method according to an embodiment of the present invention includes adjusting a first and a second valve to control the level of air flow to a first and second region of the system. The method further includes adjusting a third valve to get the air flow to the first and second valves. In an alternate embodiment, the air flow is also diffused before being directed to at least the first areas.

DETAILED DESCRIPTION OF THE PREFERRED EMBODIMENTS

Figure 1:
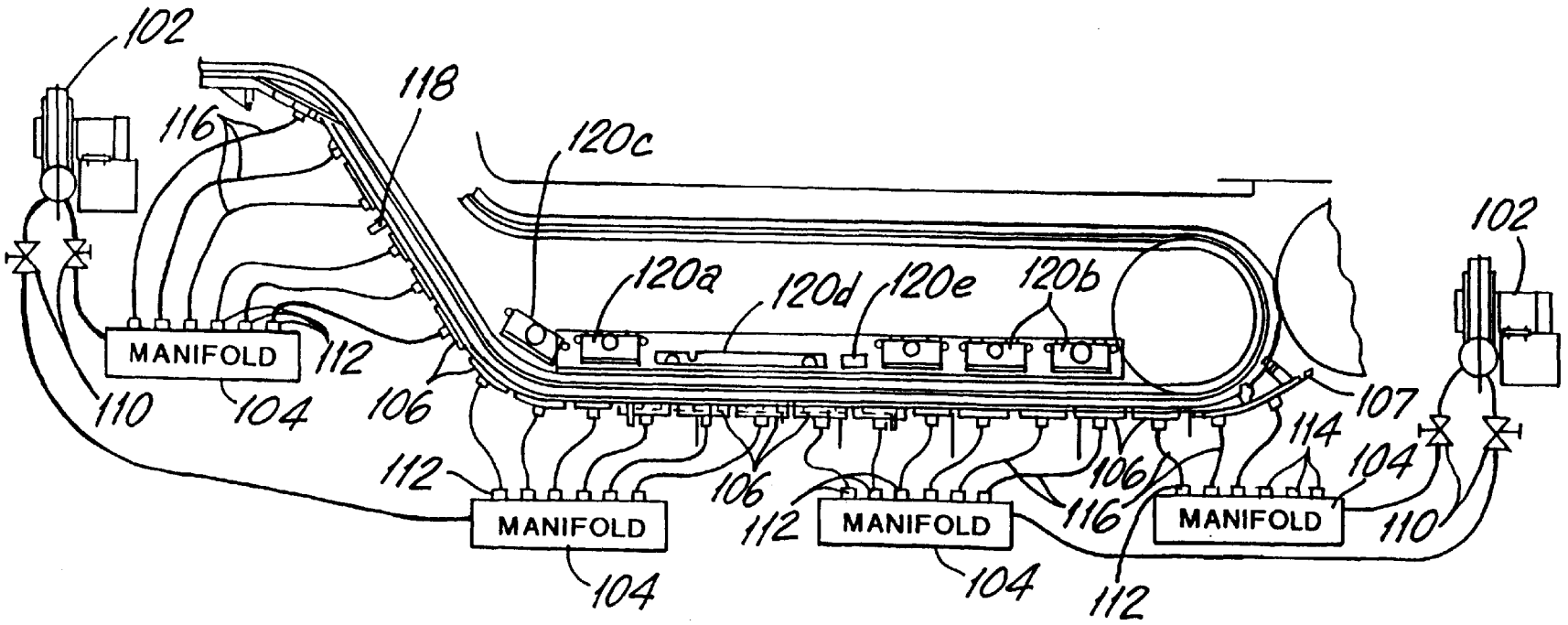
FIG. 1 is a side schematic view of a non-contact sheet handling system according to one embodiment of the present invention.

Certain preferred embodiments of the present invention will now be described in detail with reference to the drawings. Turning first to FIG. 1, a non-contact sheet handling system 100 according to the present invention is shown. The system 100 generally includes two blowers (102) each connected to two manifolds (104). Each manifold (104), in turn, is connected to up to six pans (106). Each pan (106) is secured to one of a series of non-contact plates (107).

More specifically, each manifold (104) is in fluid communication with a blower (102) by means of an air duct (108). Interposed between the blower (102) and each manifold (104) is a modulating valve (110). In the present embodiment, each manifold (104) has associated therewith its own modulating valve (110); however, in an alternate embodiment, each blower (102) has one modulating valve (110) connected thereto, with each manifold (104) connected to the modulating valve (110). As described in detail below, the modulating valves (110) function as a first level of air control.

Each manifold (104) has a series of adjustable valves (112, 114). In the present embodiment, the majority of these valves (112) are coupled to air ducts (116). Valves (114) that are not coupled to air ducts are simply closed and not in use. As described in detail below, the valves (112) function as a second level air flow control.

The air pans (106) are connected to the valves (112) and (114) by means of the air ducts (116). The pans (106) are secured around their periphery to non-contact plates (107). As discussed in greater detail below with reference to FIG. 2, the non-contact plates (107) have a series of punched openings or venturis (shown in FIG. 2 as 202), which allow the flow of air out of the pans (106). The air flowing out of the venturis (202) creates a layer of air upon which the printed sheets float. The layer of air prevents the sheets from contacting the sheet handling system (100), thereby increasing the amount of printable space on each sheet.

As shown in FIG. 1, the system 100 can accommodate a press delivery having various devices (120). For example, the delivery includes air exhausts (120*a*), hot air showers (120*b*), ambient air showers (120*c*), IR drying head (120*d*), and an air knife (120*e*). It is to be understood that the number and type of devices in the delivery is independent of the present invention.

The non-contact sheet handling system 100 also includes a track (122) for carrying the gripper bars (not shown). Although only a section of the track (122) is shown, it is to be understood that the track (122) is a continuous loop. As can be seen in FIG. 1, the track (122) generally runs parallel to the non-contact plates (107) along the path of the printed sheets. It is to be understood that the track (122) and gripper bars are independent of the present invention, and the track and gripper bars of contact sheet handling systems are suitable for use with the present invention.

The non-contact sheet handling system (100) also includes a sheet decurler (118). As shown, the sheet decurler (118) comprises a gap between two adjacent non-contact plates (107). Rather than shearing off and abutting the ends of the two plates (107), one-eight inch (0.317 cm) spacers are located between the two non-contact plates (107) to provide a substantially uniformed gap. Furthermore, the edge of each plate (107) adjacent to the gap includes about a one inch (2.54 cm) section that is bent downward, away from the sheets.

An air box is secured over the bent sections of the non-contact plates (107). The air box, in turn, includes an inlet for receiving a vacuum source. In operation, the vacuum source draws air from the gap between the non-contact plates (107). When a sheet passes over the sheet decurler (118), the vacuum momentarily pulls a portion of the sheet into the gap, thereby removing any curl in the sheet.

It is to be understood that the use of first and second level air flow control, namely the modulating valves (110) and the valves (112, 114), provide a distinct advantage in the operation of the system. During the initial installation of the non-contact sheet handling system 100, air is forced through the system 100, and the valves (112, 114) are adjusted so that the air flow to one pan (106) relative to the air flow to another pan (106) is appropriate. For example, where the non-contact plates (107) bend upward, increased air flow may be appropriate so that the printed sheets do not contact the plates (107). Similarly, in areas where the forces on the printed sheets are reduced, it may be appropriate to have an decreased air flow.

Once the relative air flow between pans (106) is set using the valves (112, 114), adjustment of the modulating valves (110) is used to provide fine adjustment of the air flow so that the non-contact system (100) may be used with sheets of different weights. For example, when changing to a heavier paper stock, the press operator need only adjust the modulating valves (110) (either manually or electronically via a computerized control) to provide a greater volume of air flow to ensure the sheets float above the non-contact plates (107). Similarly, when changing to a lighter paper stock, the press operator need only adjust the modulating valves (110) to provide less air flow to ensure no air turbulence and rippling of the sheets.

Figure 2:
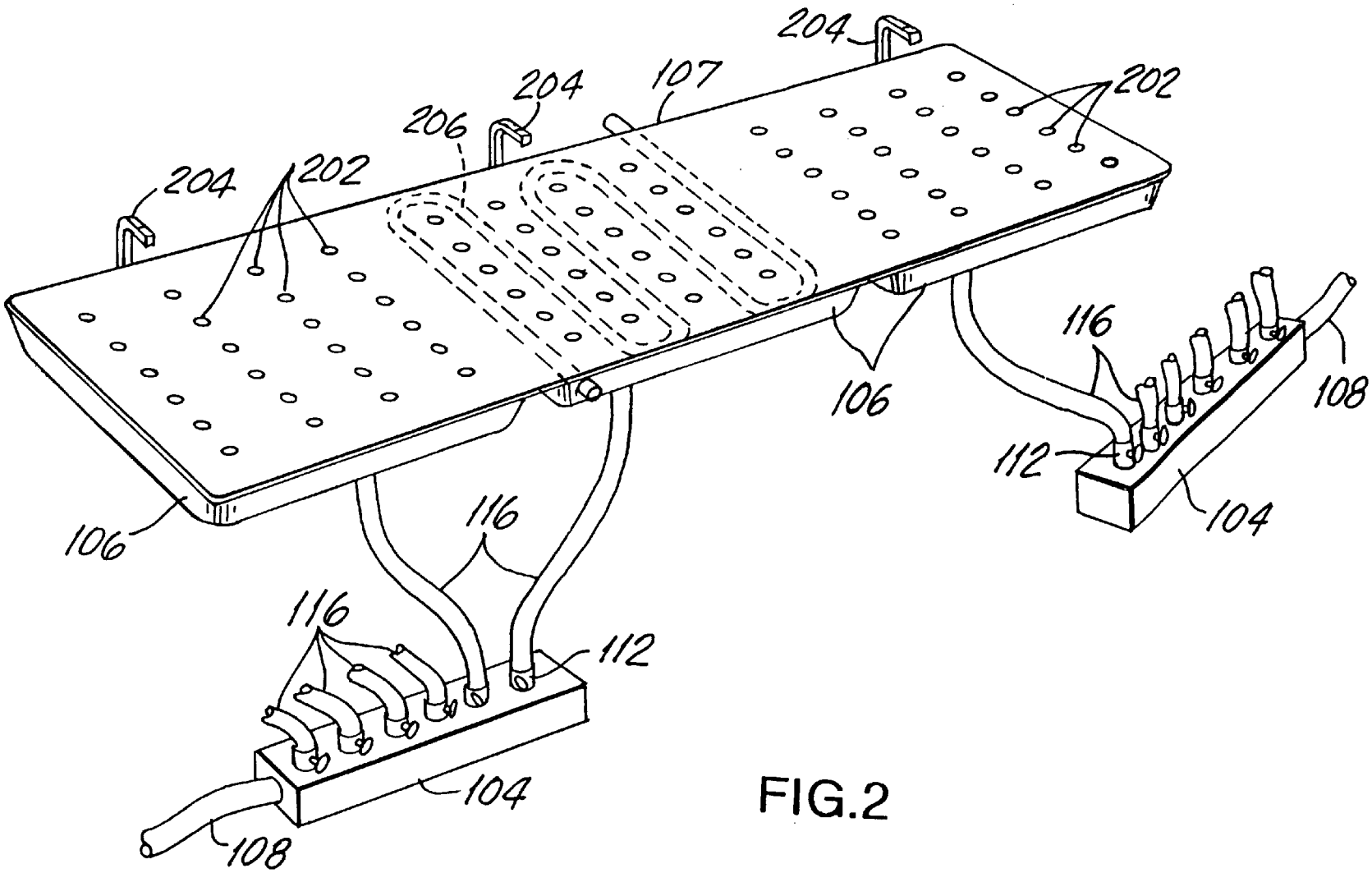
FIG. 2 is a perspective view of a section of the embodiment of FIG. 1.

A non-contact plate (107) of the present embodiment will now be described in greater detail with reference to FIG. 2 and continuing reference to FIG. 1. As shown, the non-contact plate (107) has a pattern of venturis (202) above each pan (106). Although the present invention is not limited to any particular arrangement of venturis (202), the present preferred embodiment utilizes rows of six venturis (202) spanning the width of the non- contact plates (107). More particularly, the venturis (202) are positioned such that three venturis (202) direct air onto the left half of each printed sheet, and three venturis (202) direct air onto the right half of each printed sheet. By directing air onto both halves of the printed sheet, the air flow tends to stretch the sheets, thereby preventing sagging and buckling.

The non-contact sheet handling system (100) may be mounted adjacent to the press delivery in any number of ways. In the present embodiment, mounting bars (204) are secured to the non-contact plates (107). The mounting bars (204), in turn, are mounted to the press frame. Preferably, the mounting bars (204) are located in the same position as the mounting bars used with conventional sheet handling systems, so that the conventional sheet handling systems can be readily replaced with the non-contact contact sheet handling system (100) of the present invention.

In the present preferred embodiment, a portion of the non-contact plates (107) include a fluid-cooled section. As shown in FIG. 2, the non-contact plate (107) is fitted with a conduit (206) for carrying a cooling liquid such as water. Such a water cooled section is particularly useful below the hot air showers (120*b*) and the IR drying head (120*d*). Although not shown in the figure, it is to be understood that the conduit (206) is connected to a pump and fluid source.

Figure 3:
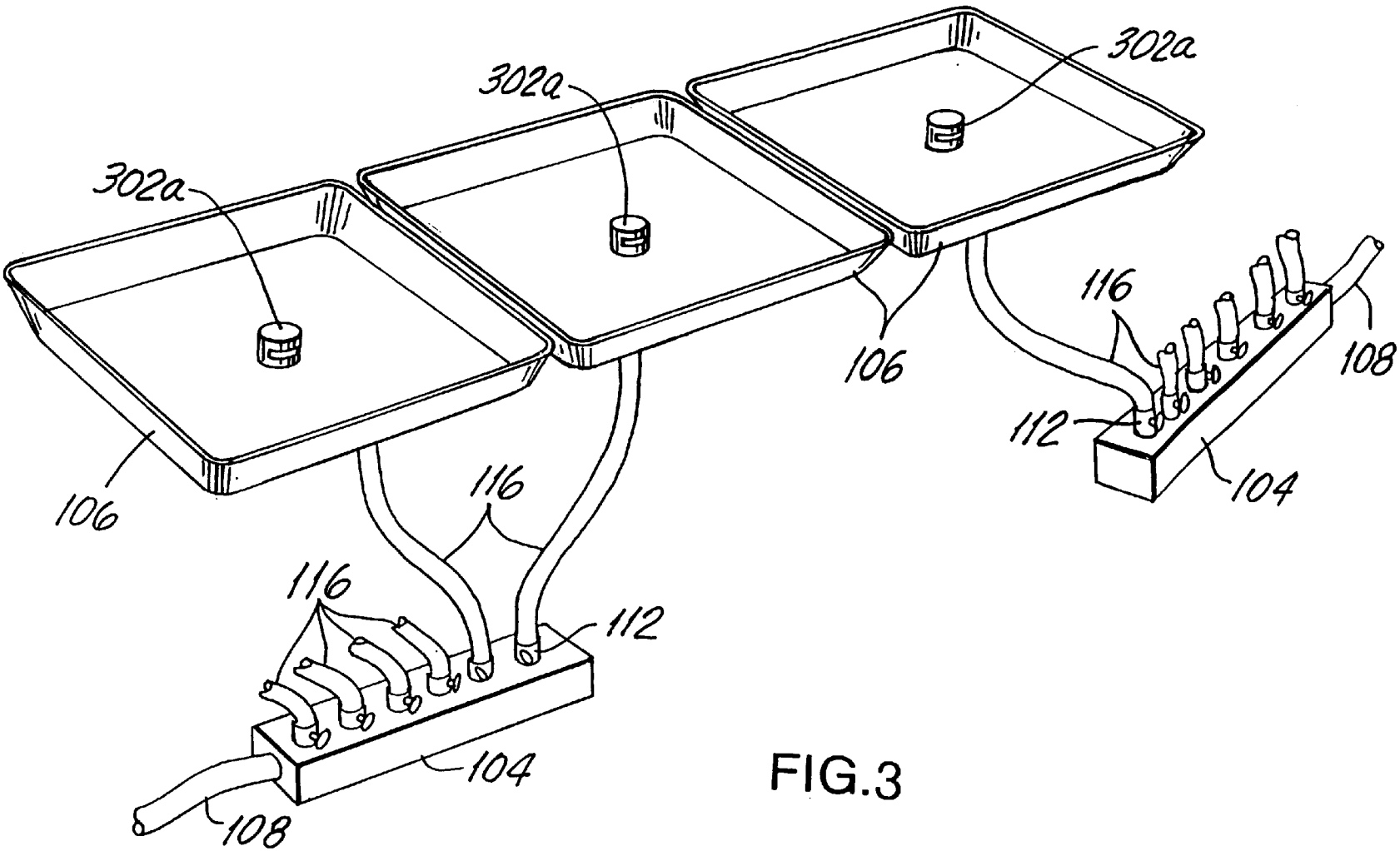
FIG. 3 is a perspective sectional view of the section shown in FIG. 2.

Turning now to FIG. 3, the air pans (106) of the present embodiment will be described in greater detail. FIG. 3 shows the section of the non-contact sheet handling system 100 shown in FIG. 2 with the non-contact plate (107) removed. Consequently, FIG. 3 illustrates the interior space of the three pans (106).

The air ducts (116) connect generally to the center of each pan (106) by means of an inlet in the bottom of each pan (106). Each inlet is fitted with a diffuser (302*a*) that slightly protrudes into the pan (106) and is interposed between the inlet and non-contact plate (107). As discussed in greater detail below, the diffuser (302*a*) insures adequate distribution of the air flow throughout each pan (106).

Figure 4A:
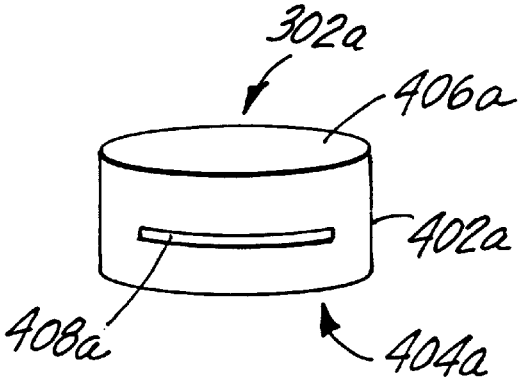
FIGS. 4*a* through 4*c* are perspective views of alternate diffusers for use with the present invention.

FIG. 4*a* illustrates the diffuser (302*a*) in greater detail. In the present preferred embodiment, the diffuser (302*a*) is a hollow cylindrical body (402*a*) having an open base (404*a*) and a closed top (406*a*). The diffuser (302*a*) also includes openings in the form of two slots (408*a*) cut into the cylindrical body (402*a*). So that the diffuser (302*a*) can be inserted into the inlet of the pan (104), its outside diameter is slightly smaller than the inside diameter of the inlet.

Although not required, it is preferable for the two slots (408*a*) to be cut in opposite halves of the cylindrical body (402*a*). With such a configuration, the diffuser (302*a*) can be inserted into the aperture in the pan (106) with the slots (408*a*) facing perpendicular to the direction of sheet movement, as shown in FIG. 3.

In operation, air is forced from the blowers (102), through the modulating valves (110) to the manifolds (104), through the valves (112), through the ducts (116), through the slots (408*a*) in the diffuser (302*a*), into the pans (106), and out the venturis (202). The slots (408*a*) function to diffuse, or disperse, the air throughout the entire pan (106), thereby insuring an even air flow out the venturis (202).

Without the diffuser (302*a*), the air flow would be directed straight out of the duct (116) and would be concentrated out the venturis (202) in the center of the non-contact plate (107). Although such concentrated air flow would likely support the center of the sheets above the non-contact plates (107), the concentrated air flow may result in turbulence and sagging of the periphery of the sheets. Thus, although a non-contact sheet handling system having no diffuser is within the scope of the present invention, use of a diffuser is preferred.

Figure 4B:
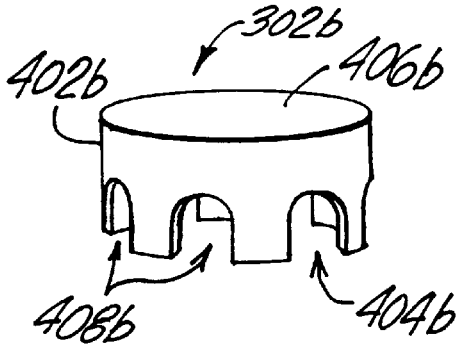

It is to be understood that other diffuser configurations are within the scope of the present invention. For example, FIG. 4*b* illustrates an alternative diffuser (302*b*). The diffuser (302*b*) includes a hollow cylindrical body (402*b*) having an open base (404*b*) and a closed top (406*b*). The diffuser (302*b*) is scalloped, having openings (408*b*) in the body (402*b*) to allow for air flow.

Figure 4C:
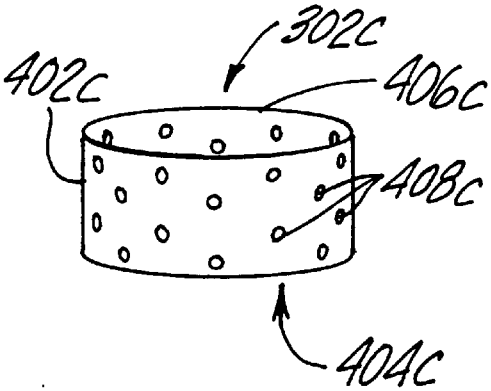

FIG. 4*c* illustrates another alternate configuration for a diffuser. Similar to those shown in FIGS. 4*a* and b, the diffuser (302*c*) includes a hollow cylindrical body (402*c*) having an open base (404*c*) and a generally closed top (406*c*). In order to diffuse the air flow, the diffuser (302*c*) includes openings for perforations (408*c*) in both the body (402*c*) and the top (406*c*).

Figure 5:
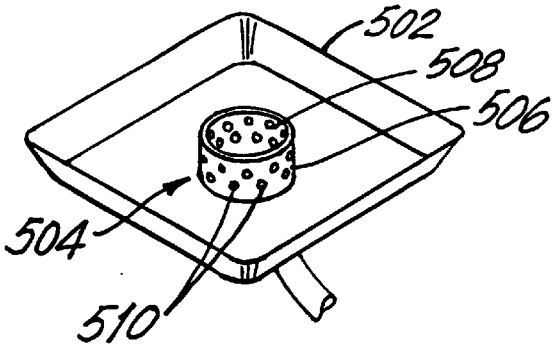
FIG. 5 is a schematic view of an air pan and a diffuser according to an alternate embodiment of the present invention.

It is to be understood that different diffuser configurations are within the scope of the present invention. In other alternate embodiments, for example, the diffusers are not placed in the pan inlet, but rather are placed in the interior of the pan, over the inlet. One such embodiment is shown in FIG. 5. As illustrated, the air pan (502) includes a diffuser (504) placed over the inlet (not shown). The diffuser (504) comprises a hollow cylindrical body (506) and a closed top (508). In order to provide diffused air flow, the diffuser (504) includes a series of openings (510). It should be noted that in embodiments using a diffuser placed over the pan inlet, the diffuser configuration may vary as described above with reference to FIGS. 4*a–c*.

Figure 6A:
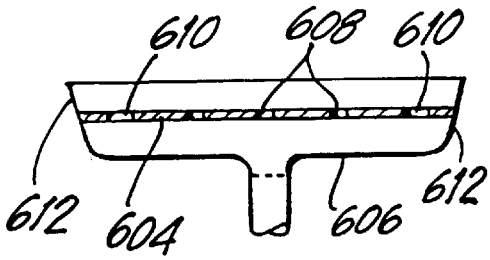
FIGS. 6*a* and 6*b* are a sectional side view and a perspective view, respectively, of an air pan and a diffuser according to an alternate embodiment of the present invention.
Figure 6B:
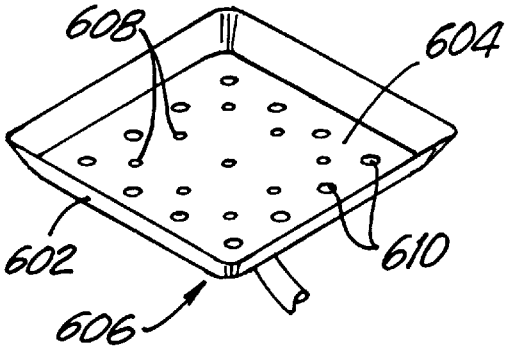

Yet another embodiment of the diffuser will now be described with reference to FIGS. 6*a* and b. As shown therein, the air pan (602) includes a diffuser (604) generally configured as a shelf or plate in the pan (602). More specifically, the diffuser (604) has an outside diameter slightly smaller than the inside diameter of the top of the pan (602) such that the diffuser (604) fits into the pan (602). In the present embodiment, the diffuser (604) includes two different sized openings (608, 610). To allow for even distribution of air flow through the non-contact plate (not shown) that fits over the air pan (602), the openings (608) in the center of the diffuser (604) are smaller than the openings (610) around the perimeter of the diffuser (604). It should be noted that such an arrangement of different sized openings may be applied to essentially any diffuser configuration.

As shown, the diffuser (604) rests above the bottom (606) of the pan (602). This is achieved by having the diffuser (604) rest on the tapered sides (612) of the air pan (602). It is to be understood that diffusers of the type illustrated in FIGS. 6*a* and *b* may be secured in place in any other of a number of ways. For example, such a diffuser in the form of a plate or shelf may rest on tapered sides of the pan, soldered in place, placed on flanges extending from the side walls of the air pan, or the like.

Figure 7:
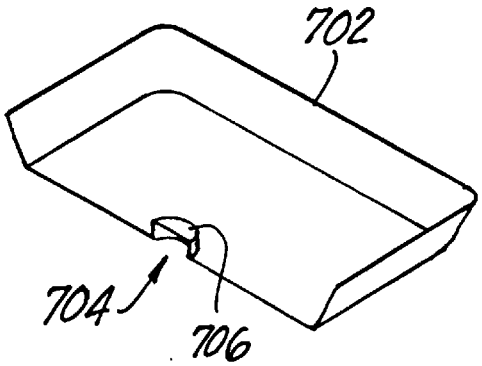
FIG. 7 is a sectional perspective view of an air pan and a diffuser according to an alternate embodiment of the present invention.

In still other alternate embodiments that utilize diffusers, the diffusers are not separate from the air pans, but rather are integrally formed therein. In one such embodiment, as shown in FIG. 7, the diffuser (704) is formed in the bottom of the pan (702). Similarly, openings (706) are punched in the diffuser (704).

Figure 8:
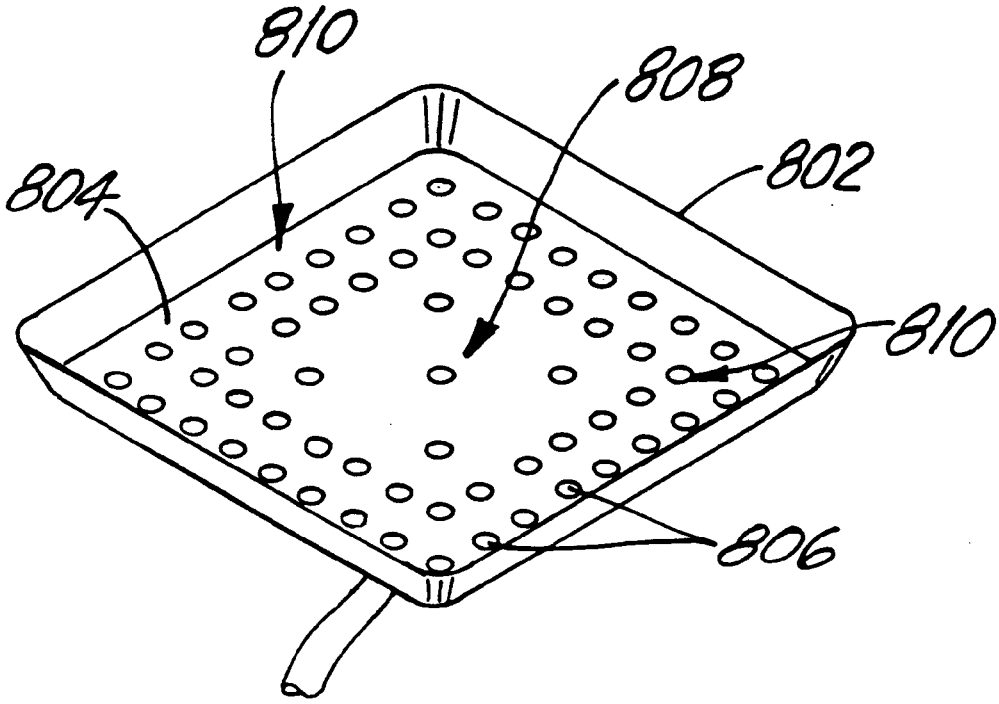
FIG. 8 is a perspective view of an air pan and a diffuser according to an alternate embodiment of the present invention.

Yet another alternate embodiment will now be described with reference to FIG. 8. As shown therein, the air pan (802) (like the air pan (602) of FIGS. 6*a* and b) includes a diffuser (804) in the form of a plate that sits in the pan (802). In the present embodiment, the diffuser (804) includes openings (806) arranged in varying densities. The first density pattern (808) is located near the center of the diffuser (804). The second density pattern is located around the periphery of the diffuser (804). The density of the second pattern (810) is greater than that of the first pattern (808) so that the air flow is diffused away from the center of the air pan, where the inlet is located.

It is to be understood that in the preferred embodiment of FIGS. 1–3 and 4*a*, various device specifications and dimensions may be suitable. Ideally, the airflow through each venturi (202) should be depending upon location between 2 and 5 standard cubic feet per minute.

It is also to be understood that other alternate embodiments are within the scope of the present invention. For example, embodiments are not limited to the number of blowers, manifolds, air pans, and other components shown. For example, a non-contact sheet handling system according to an alternate embodiment uses only one blower or other source of air flow. Similarly, the present invention is not limited to any particular number of non-contact plates. Thus, the present invention covers systems utilizing one or more non-contact plates. Furthermore, manifolds, air pans, diffusers, and other components having different shapes may be used and combined in the same system. For example, the manifolds may be in the form of a portion of a sphere, having only one wall.

It is to be understood that the term manifold, as used herein, refers to any structure that has a given number of inlets and a given number of outlets. Such structures include arrangements of one or more "T" or "Y" shaped connectors.

Although the air pans of each of the embodiments described herein included inlets located substantially in the center of the bottom, it is to be understood that other configurations are within the scope of the present embodiment. For example, air pans having inlets in one or more of the bottom and/or sides can be used.

Although the present invention has been described in terms of certain preferred embodiments, other embodiments that are apparent to those of ordinary skill in the art are intended to be within the scope of this invention. Accordingly, the scope of the present invention is intended to be limited only by the claims apprehended here.

What is claimed is:

1. A sheet handling system for connection to a source of air, the system comprising:

a manifold for receiving air from the source;

a first modulating valve in fluid communication with the manifold and interposed between the manifold and the source of air, the first valve controlling airflow to the manifold;

an air pan having an inlet and an open top;

a second valve in fluid communication with the manifold and the air pan, the second valve controlling air flow to the air pan; and at least one non-contact plate covering the top of the air pan, the non-contact plate having a plurality of venturis.

2. The system of claim 1 further comprising a diffuser interposed between the inlet and the non-contact plate.

3. The system of claim 2 wherein the diffuser includes a hollow body having openings, an open bottom and a closed top, the openings allowing diffuse air flow throughout the pan.

4. The system of claim 3 wherein the diffuser is positioned in the inlet.

5. The system of claim 3 wherein the diffuser is positioned in the pan, over the inlet.

6. The system of claim 3 wherein the diffuser is integrally formed in the pan.

7. The system of claim 2 wherein the diffuser is a plate having a plurality of openings.

8. The system of claim 2 wherein the pan further has tapered sides and the diffuser rests on the tapered sides.

9. The system of claim 2 wherein the openings in the diffuser are of varying size.

10. The system of claim 2 wherein the openings in the diffuser are located in varying densities.

11. The system of claim 1 wherein the system further includes a plurality of air pans and a plurality of second valves, the manifold being in fluid communication with the plurality of second valves, the second valves controlling air flow to the plurality of air pans.

12. The system of claim 11 wherein all of the air pans include a diffuser.

13. The system of claim 1 wherein the non-contact plate includes a conduit for carrying a cooling fluid.

14. A method of controlling air to a non-contact sheet handling system, the method comprising:

providing a manifold for receiving airflow from a source of air;

adjusting a first valve to set airflow to a first area of the system, wherein the first valve is in fluid communication with the manifold and the first area of the system;

adjusting a second valve to set airflow to a second area of the system, wherein the second valve is in fluid communication with the manifold and the second area of the system; and adjusting a third valve to set airflow to the first and second valves, wherein the third valve is interposed between the manifold and the source of air.

15. The method of claim 14 wherein the steps of adjusting the first and second valves occur prior to adjusting the third valve.

16. The method of claim 14 wherein the step of adjusting the third valve is performed when changing the types of sheets handled by the system.

17. The method of claim 14 wherein a first air pan defines the first area, and the method further includes the step of diffusing air flow throughout the first pan.

18. A method for operating a non-contact sheet handling system, the method comprising:

generating an air flow;

directing the air flow through a first valve;

directing the air flow from the first valve into a manifold and through a plurality of second valves to a plurality of air pans, each of the air pans having an interior space; and diffusing air flow in the interior space of the air pans.

19. The method of claim 18 wherein the step of generating the air flow is accomplished with at least one blower.

20. An air pan for use in a non-contact sheet handling system, the air pan comprising:

one or more walls, at least one of the walls having an inlet for receiving air flow from a manifold comprising a plurality of first valves, the manifold receiving air flow from a second valve that sets airflow to the plurality of first valves, wherein air flow from at least one of the first valves of the manifold is directed to the inlet;

the walls defining an interior space; and a diffuser within the interior space.

21. The air pan of claims 20 wherein the diffuser is integrally formed in a wall of the pan.

22. The air pan of claim 20 wherein the diffuser is positioned in the inlet.

23. The air pan of claim 20 wherein the diffuser is a plate located in the air pan.

24. The air pan of claim 23 wherein the diffuser is located over the inlet.

25. The air pan of claim 20 wherein the diffuser includes openings of different sizes.

26. The air pan of claim 20 wherein the diffuser includes openings arranged in varying densities.

* * * * *